United States Patent [19]

Fleming

[11] Patent Number: 4,533,051

[45] Date of Patent: Aug. 6, 1985

[54] BOTTLE HOLDER

[76] Inventor: Ray D. Fleming, 803 Arrah, Friona, Tex. 79035

[21] Appl. No.: 607,233

[22] Filed: May 4, 1984

[51] Int. Cl.[3] ..... B65D 1/36; B65D 6/04

[52] U.S. Cl. ..... 206/563; 206/558; 206/589; 206/592; 206/581

[58] Field of Search ..... 206/563, 558, 581, 589, 206/592; 211/74

[56] References Cited

U.S. PATENT DOCUMENTS

| | | | |
|---|---|---|---|
| D. 126,052 | 3/1941 | Petzold | 206/564 |
| 1,735,183 | 11/1929 | Salerno | 206/581 |
| 2,935,206 | 5/1960 | Smith | 206/564 |
| 2,954,898 | 10/1960 | Freeberg | 206/581 |
| 2,963,167 | 12/1960 | Norman | 211/74 |
| 3,203,540 | 8/1965 | Kalt et al. | 206/589 |
| 3,982,551 | 9/1976 | Bartolucci | 206/581 |
| 4,256,457 | 3/1981 | Behring | 206/558 |

FOREIGN PATENT DOCUMENTS

| | | | |
|---|---|---|---|
| 170898 | 4/1952 | Austria | 206/558 |
| 2254138 | 5/1974 | Fed. Rep. of Germany | 206/575 |
| 1053260 | 12/1966 | United Kingdom | 206/563 |
| 1517592 | 7/1978 | United Kingdom | 206/581 |

*Primary Examiner*—William T. Dixson, Jr.
*Assistant Examiner*—Brenda J. Ehrhardt
*Attorney, Agent, or Firm*—Wendell Coffee

[57] ABSTRACT

A holder for bottles, brushes, shields and the like is provided. The holder is particularly adapted to hold material manicurist use to construct artificial fingernails and to repair natural fingernails.

4 Claims, 4 Drawing Figures

BOTTLE HOLDER

CROSS REFERENCE TO RELATED APPLICATIONS

None.

BACKGROUND OF THE INVENTION

1. Field of the Invention

This invention relates to a special reciprocal support for a bottle or jar.

2. Description of the Prior Art

In manicuring today, exotic materials are used to construct artificial nails and to repair natural nails. These materials are expensive inasmuch as it is necessary for them to withstand severe service of the finger nails. In addition to this, it is necessary that the material be compatible with the human body. Often, they are applied in circumstances wherein the person to which they are applied may be nervous or may be engaged in reading or other activities. As a result of this extraneous activity, often, the bottles or jars of the expensive material are turned over or knocked to the floor, resulting in loss of the expensive material and perhaps damage to clothing or furnishings.

Supports or holders for bottles and jars have been known before Applicant's invention. For example, ink stands have been know to hold ink with the pens therefore. See HARRINGTON U.S. Pat. No. 6,510 (1831).

Others have invented holders for crayons. See LEU U.S. Pat. No. 3,905,529 (1975).

Others have invented racks for holding catsup bottles while draining other bottles thereto, having handles thereon. WHITE U.S. Pat. No. 3,860,048 (1975).

ZREBIEC U.S. Pat. No. 1,474,753 (1923) discloses holder for flower pots.

Before this application was filed, Applicant caused a search to be made in the U.S. Patent and Trademark Office. In addition to the above described patents, the Searcher found the following patents:

SILVER: U.S. Pat. No. 1,869,717
HASENOUR: U.S. Pat. No. 1,972,519
VERCELLOTTI: U.S. Pat. No. 3,331,645
LAWRENCE: U.S. Pat. No. 3,352,427
NOACK: U.S. Pat. No. 4,411,868

Applicant does not consider these patents to be as related to his invention as the four (4) specifically described above, but brings them to the attention of the Examiner inasmuch as Applicant believes the Examiner would be interested in any reference returned by an experienced patent searcher.

SUMMARY OF THE INVENTION (1) New Functions and Surprising Results

I have developed a holder particularly adapted for holding the bottles, jars, brushes and shields or forms used by manicurist in the construction of artificial nails or in the repair of natural nails. I have particularly adapted the holder for holding not only the bottles and jars, but also the droppers used in mixing the material.

(2) Objects of this Invention

An object of this invention is to hold bottles, jars, brushes, shields, and droppers in one convenient holder.

Further objects are to achieve the above with a device that is sturdy, compact, durable, simple, safe, efficient, versatile, ecologically compatible, energy conserving, and reliable, yet inexpensive and easy to manufacture, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
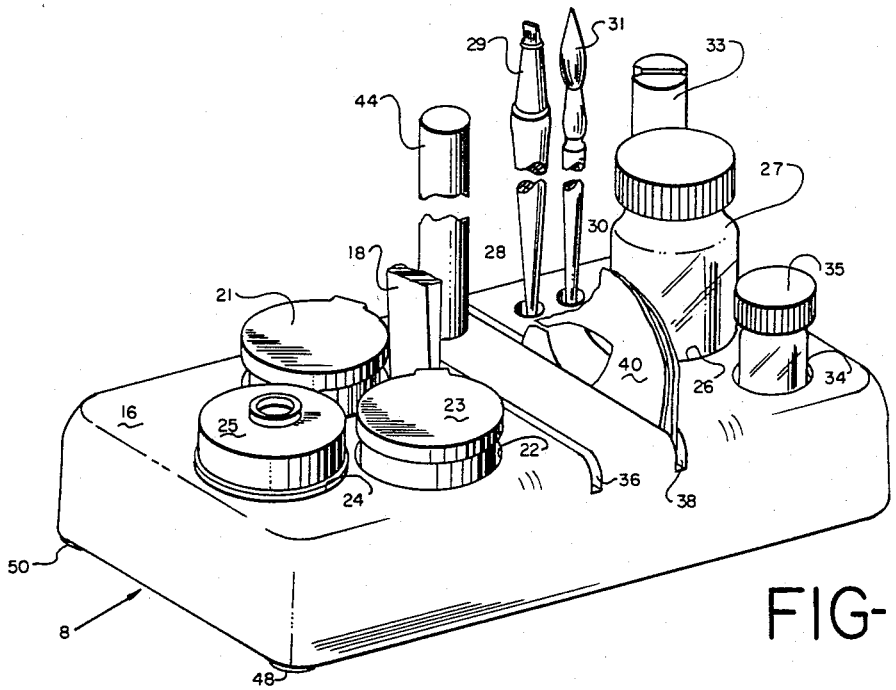
FIG. 1 is a perspective view of my invention with the material placed therein, with some of the taller material and the handle foreshortened for clarity of drawings.
Figure 2:
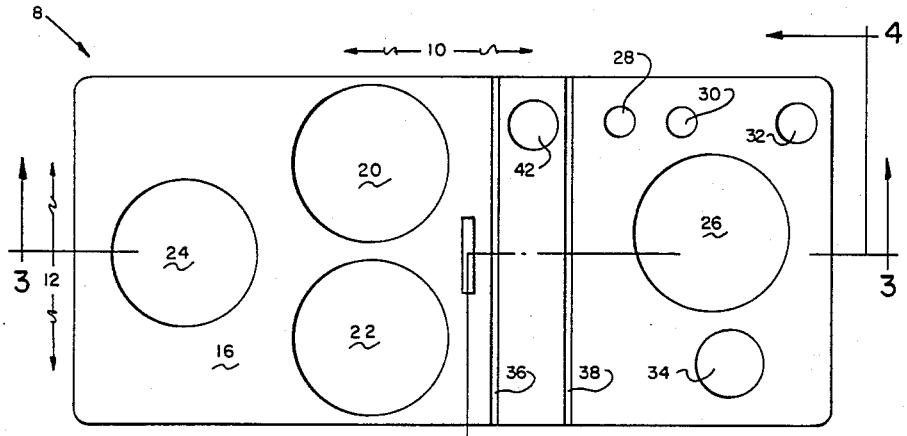
FIG. 2 is a top plan view of the holder.
Figure 3:
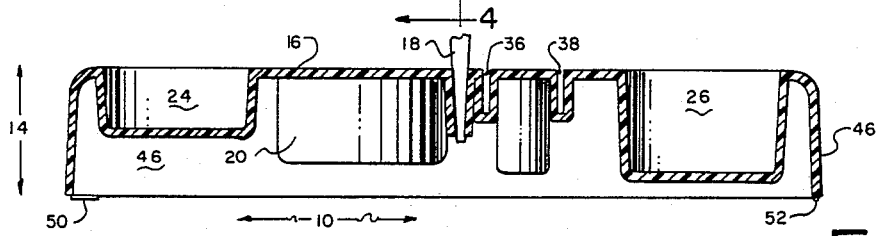
FIG. 3 is a longitudinal sectional view taken substantially along line 3—3 of FIG. 2.
Figure 4:
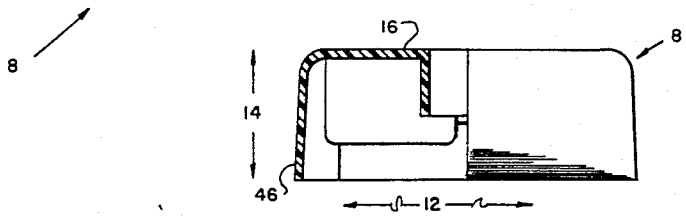
FIG. 4 is a half sectional half elevational view taken substantially along lines 4—4 of FIG. 2.

The material of which the holder is built may vary. Wood is a suitable material. A 2"×4" block, i.e., wood having actual dimensions of 3.5" wide by 1.5" deep, and 7" long is suitable material. However, finding uniform pieces of high quality wood is difficult and making it of wood is somewhat expensive. Therefore, a preferred material is synthetic plastic material which can be quickly molded into shape.

The drawings illustrate a holder made of plastic material, however, be understood that it could also be made of other material. The holder includes rectangular base 8. It has approximately the dimensions described above, but in any event, it will have a length 10 of at least as half again as large as the width 12. The width 12 will be at least twice as much as the depth 14.

The holder will have a planer top 16.

Handle 18 projects upward from the planer top 16 at about the center of gravity, which is about the middle of the top. Specifically, the drawings illustrate a model which is 7" in length, 3.86" in width, and 1.5" in height. The handle would project upward 1.95" above the planer top 16.

Between the handle and one side are three holes, as shown. Holes 20 and 22 are each 1.5" in diameter and 0.95" deep. Center hole 24 is near one of the edges but is centered from side to side as shown. It is 1.34" in diameter and is 0.65" in depth. Opposite hole 26 is near the longitudinal center line on the opposite end from hole 24, but hole 26 is 1.32" diameter and 1.1" deep. Thus, it may be seen that there are at least four holes in the top 16 that have a diameter greater than their depth.

Also, referring to FIG. 1, it may be seen that these holes are for bottles or jars 21, 23, 15, and 27. In addition, there are at least two small cylindrical holes having a diameter less than their depth. This would include holes 28 and 30 for brushes 29 and 31. They are each 0.21" in diameter and 1.1" deep. Hole 32, for dropper 33, is 0.335" in diameter and also 1.1" deep. The two brush holes 28 and 30 and the dropper hole 32 are in line on one side of the opposite hole 26. On the other side from the three holes 28, 30, and 32, is another small diameter hole 34 for a small bottle 35 which is 0.77" in diameter and 0.9" deep. As it may be seen, it also has a diameter smaller than its depth.

Between the holes, as described, i.e., between the holes 20, 22, and 24, on one side of the handle and holes 26, 28, 30, 32 and 34, on the other side, are slots 36 and 38. These slots are parallel to one another, spread about 0.8" apart and about 0.5" deep, and extend from one side to the other. They are also call elongated slots. They are for shields 40 to be placed in. Those having skill in the manicurist art will recognize that the shields are used when either building artificial nails or repairing natural nails. The slot 36 is adjacent to the handle 18, while the slot 38 is adjacent to the brush hole 28 and the opposite hole 26.

A dowel hole 42 is located between the two slots adjacent to one side, i.e., just across the slot 38 from the brush hole 28. The dowel hole is 0.52" in diameter and 1" in depth. I.e., it also has a diameter smaller than its depth. Dowel 44 is located in the dowel hole and is used in forming the artificial nails and also forming the shields to correctly fit upon the fingers of the person who is having the nails installed. All will be understood by those having ordinary manicurist skills.

Three feet are formed on the bottom of the plastic, making up the walls 46 of the base 8. Two of these feet 48 and 50 are located at the corners underneath the side, having the large hole, particularly the center line hole 24. One foot 52 is located on the longitudinal center line on the opposite edge of base 8. Each of these feet project down less than the thickness of the wall, which is about 0.09". By placing three feet upon it, the base will always set level and without tottering.

Thus, it may be seen that I have provided a bottle holder or a holder for material particularly suited for manicurist. Of course, it will be understood that the bottles or jars 21, 23, 25, and 27 in the various holes 20, 22, 24, and 26 will have either granular material or liquid or semiliquid material to be used upon the fingernails. The dropper 33 in the dropper hole 32 provides convenient means for putting small amounts of one liquid into some of the other material in some of the jars, such as one of the jars 35 into the center line jar 25, where it is to be used. Brushes 29 and 31 are used in applying the material to the finger nails. It will be understood that although this description is extensive, it is not complete. For example, those having ordinary skill in the art will understand that the corners will be curved and that also, the walls will have draft so that the base can be removed from the mold after being made. Reenforcements can be provided between some of the holes and the side walls.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific examples above do not point out what an infringement of this patent would be, but are to enable the reader to make and use the invention.

I claim as my invention:

1. A holder for material comprising:

a. a rectangular base having a length of about 7" and a width of about 3.8" and a height of about 1.5", b. a planer top, c. a handle at about the center of gravity of the base which is about the middle of the planer top, d. said handle projecting up from the planer top about 2" above the planer top, e. two holes near the handle, each of about 1.5" in diameter and about 1" deep, f. a center hole on the longitudinal center line of the base, g. said center hole having a diameter of about 1.33" and a depth of about 0.66", h. an opposite hole near the longitudinal center line on the opposite end of the rectangular base, having a diameter of about 1.33" and a depth of about 1.1", i. two elongated slots, j. said slots spaced apart about 0.8", and about 0.5" deep and extend from side to side.

k. a dowel hole between the slots about 0.5" in diameter and about 1" in depth, l. two brush holes in the top near the opposite hole, m. each brush hole being about 0.2" in diameter and about 1.1" deep, n. a dropper hole near the brush holes, o. said dropper hole having a diameter of about 0.33" and a depth of about 1.1", p. a small bottle hole near the opposite hole, q. said small bottle hole having a diameter of about 0.75" and a depth of about 0.9".

2. The invention as defined in claim 1 having limitations a through q further comprising:

r. shields in the elongated slots, s. dowel in the dowel hole, t. a brush in each of the brush holes, u. a dropper in the dropper hole, v. a bottle in the opposite hole, w. a bottle in the small bottle hole, x. a jar in the center hole.

3. The invention as defined in claim 1 having limitations a through x further comprising:

y. manicurist materials in said bottles.

4. A holder for material comprising:

a. rectangular base, b. a planer top, c. a handle projecting from the top about in the middle of the top, d. three holes between the handle and one end, e. each of said three holes having a diameter greater than the depth, f. two elongated slots adjacent to the handle extending across the planer top adjacent to the handle and opposite said three holes, g. an opposite hole in the planer top between the slots and the edge of the planer top, h. said opposite hole having a diameter larger than its depth, i. a dowel hole between the slots, j. said dowel hole having a depth greater than its diameter, k. two brush holes on the same side of the slots as the opposite hole near the dowel hole, l. said brush holes having depths greater than their diameter, m. a dropper hole near said brush holes, n. said dropper hole having a depth greater than its diameter, and o. a small bottle hole near the opposite hole, p. said small bottle hole having a depth greater than its diameter, q. a dowel in the dowel hole, r. a brush in each of said brush holes, s. a dropper in the dropper hole, t. at least one shield in at least one of said elongated slots, u. a bottle in the opposite hole and the small bottle hole, v. a jar in at least one of said three holes, and w. manicurist materials in said bottles.

* * * * *